US007734228B2

(12) United States Patent
Senoh

(10) Patent No.: US 7,734,228 B2
(45) Date of Patent: Jun. 8, 2010

(54) DEVELOPMENT DEVICE, PROCESS CARTRIDGE, AND IMAGE FORMING APPARATUS

(75) Inventor: Tetsuya Senoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/757,046

(22) Filed: Jun. 1, 2007

(65) Prior Publication Data

US 2007/0280740 A1 Dec. 6, 2007

(30) Foreign Application Priority Data

Jun. 6, 2006 (JP) ..... 2006-156783

(51) Int. Cl.
*G03G 15/08* (2006.01)

(52) U.S. Cl. ..... 399/254

(58) Field of Classification Search ..... 399/254, 399/256, 263

See application file for complete search history.

(56) References Cited

U.S. PATENT DOCUMENTS 5,151,739 A * 9/1992 Hediger ..... 399/256
5,220,382 A * 6/1993 Hediger ..... 399/256
5,572,299 A * 11/1996 Kato et al. ..... 399/256
5,963,766 A * 10/1999 Okuno et al. ..... 399/256
2005/0196194 A1* 9/2005 Suda et al. ..... 399/111

FOREIGN PATENT DOCUMENTS

| | | |
|---|---|---|
| JP | 10-339991 | 12/1998 |
| JP | 11-24382 | 1/1999 |
| JP | 2004-191862 | 7/2004 |
| JP | 2006-3524 | 1/2006 |

OTHER PUBLICATIONS

U.S. Appl. No. 12/049,838, filed Mar. 17, 2008, Senoh et al.

* cited by examiner

*Primary Examiner*—David M Gray
*Assistant Examiner*—Andrew V Do
(74) *Attorney, Agent, or Firm*—Oblon, Spivak, McClelland, Maier & Neustadt, L.L.P.

(57) ABSTRACT

The present invention provides a development device which does not accumulate the developer at the corners on the internal walls, the process cartridge having such a development device, and the image forming apparatus, without increasing the size of the device or complicating its structure. A curving surface section is provided in at least one of four sections where internal walls in which bearings of the first rotary conveying body and the second rotary conveying body are positioned intersect with internal walls that are parallel to the first rotary conveying body and the second rotary conveying body.

14 Claims, 13 Drawing Sheets

FIG. 9A

P/R, Q/R

UNIT: mm

| | | | |
|---|---|---|---|
| HEIGHT | 10.0 | 0.0 | 0.0 |
| ROTARY CONVEYING BODY LENGTH OF PARALLEL DIRECTION | 0.0 | 10.0 | 0.0 |
| ROTARY CONVEYING BODY LENGTH OF PERPENDICULAR DIRECTION | 0.0 | 0.0 | 5.0 |

FIG. 9B

P/S, Q/S

UNIT: mm

| | | | |
|---|---|---|---|
| HEIGHT | 8.0 | 0.0 | 0.0 |
| ROTARY CONVEYING BODY LENGTH OF PARALLEL DIRECTION | 0.0 | 10.0 | 0.0 |
| ROTARY CONVEYING BODY LENGTH OF PERPENDICULAR DIRECTION | 0.0 | 0.0 | 5.0 |

UNIT: mm

| | |
|---|---|
| LENGTH | 8.0 |
| WIDTH | 5.0 |
| THICKNESS | 0.5 |
| ROTARY CONVEYING BODY DISTANCE FROM END POINT | 1.0 |

UNIT: g

| | P/R | P/S | Q/R | Q/S | TOTAL |
|---|---|---|---|---|---|
| A | 0.6 | 0.2 | 0.4 | 0.1 | 1.3 |
| B | 0.1 | 0.0 | 0.0 | 0.0 | 0.1 |
| C | 0.1 | 0.0 | 0.1 | 0.0 | 0.2 |

DEVELOPMENT DEVICE, PROCESS CARTRIDGE, AND IMAGE FORMING APPARATUS

BACKGROUND OF THE INVENTION

1. Field of the Invention

The present invention relates to an image forming apparatus, such as a copying machine, a facsimile device, and a printer. More particularly, the present invention relates to a development device installed in such image forming apparatus, and a process cartridge having the development device.

2. Description of the Related Art

In a development device in which developer is circulated and conveyed between a first chamber and a second chamber by two rotary conveying bodies, the developer that is conveyed from an upstream applies, to a downstream developer, force parallel to the direction of travel of the developer, and then the downstream developer is pushed toward a downstream in order to eliminate the pressure caused by the application of the force, whereby the developer, which is positioned in a location where the rotary conveying body does not directly passes through, is moved. In the vicinity of the bearing of the rotary conveying body, the direction of the pressure that the downstream developer receives from the upstream developer is substantially perpendicular to the direction of the movement of the downstream developer, and the flow of the developer is extremely worse at a corner of an internal wall, compared to other positions, thus the developer is accumulated easily.

Furthermore, there are the following two problems in accumulation of the developer at the corner of the internal wall.

(1) The temperature in the vicinity of the bearing of the rotary conveying body is higher than that of the peripheral area because of sliding heat, and the accumulated developer continuously receives pressure from the developer conveyed from the upstream, causing a problem such as developer aggregation.

(2) Even if the developer is not accumulated completely, the developer in the vicinity of the corner of the internal wall does not move easily, compared to the developer located in other position, thus such developer is not stirred sufficiently, whereby the uniformity of the toner density and charging volume in the entire developer is deteriorated.

Therefore, in order to solve these problems, there is known a development device disclosed in, for example, Japanese Unexamined Patent Publication No. 2006-003524. However, as will be described hereinafter with reference to the drawings, there is a problem that the size of the development device is large, causing increase in the production cause.

Technologies relating to the present invention are also disclosed in, e.g., Japanese Unexamined Patent Publication No. H10-339991 and Japanese Unexamined Patent Publication No. H11-024382.

SUMMARY OF THE INVENTION

The present invention is therefore contrived in view of such circumstances, and an object thereof is to provide a development device which does not accumulate developer at a corner on an internal wall, a process cartridge having such a development device, and an image forming apparatus having either the development device or the process cartridge, without increasing the size of the device or complicating its structure.

In an aspect of the present invention, a development device comprises a developer carrier that develops an electrostatic latent image to obtain a toner image; a first chamber that houses a first rotary conveying body supplying a developer to the developer carrier; and a second chamber that houses a second rotary conveying body that rotate to convey the developer in a direction opposite to a direction in which the first rotary conveying body conveys the developer. The first chamber and the second chamber are partitioned by a partition member having an opening section at each end thereof, whereby the developer is circulated and moved via the opening sections, and a curving surface section is provided in at least one of four sections where internal walls in which bearings of the first rotary conveying body and the second rotary conveying body are positioned intersect with internal walls that are parallel to the first rotary conveying body and the second rotary conveying body.

In another aspect of the present invention, a development device comprises a developer carrier that develops an electrostatic latent image to obtain a toner image; a first chamber that houses a first rotary conveying body supplying a developer to the developer carrier; and a second chamber that houses a second rotary conveying body that rotates to convey the developer in a direction opposite to a direction in which the first rotary conveying body conveys the developer. The first chamber and the second chamber are partitioned by a partition member having an opening section at each end thereof, whereby the developer is circulated and moved via the opening sections, and an abutting member, installed in at least either one of bearings of the first rotary conveying body and the second rotary conveying body, rotates along with the bearing of the rotary conveying body in which the abutting member is installed, and abuts on an internal wall that is parallel to the rotary conveying body in which the abutting member is installed.

In another aspect of the present invention, a development device comprises a developer carrier that develops an electrostatic latent image to obtain a toner image; a first chamber that houses a first rotary conveying body supplying a developer to the developer carrier; and a second chamber that houses a second rotary conveying body that rotates to convey the developer in a direction opposite to a direction in which the first rotary conveying body conveys the developer. The first chamber and the second chamber are partitioned by a partition member having an opening section at each end thereof, whereby the developer is circulated and moved via the opening sections, a curving surface section is provided in at least one of four sections where internal walls in which bearings of the first rotary conveying body and the second rotary conveying body are positioned intersect with internal walls that are parallel to the first rotary conveying body and the second rotary conveying body, and an abutting member, installed in at least either one of bearings of the first rotary conveying body and the second rotary conveying body, rotates along with the bearing of the rotary conveying body in which the abutting member is installed, and abuts on an internal wall that is parallel to the rotary conveying body in which the abutting member is installed.

In another aspect of the present invention, a process cartridge detachable to an image forming apparatus and comprises a development device; and an image carrier that supports an electrostatic latent image. The development device comprises a developer carrier that develops an electrostatic latent image to obtain a toner image; a first chamber that houses a first rotary conveying body supplying a developer to the developer carrier; and a second chamber that houses a second rotary conveying body that rotates to convey the developer in a direction opposite to a direction in which the first rotary conveying body conveys the developer. The first chamber and the second chamber are partitioned by a partition member having an opening section at each end thereof, whereby the developer is circulated and moved via the opening sections. A curving surface section is provided in at least one of four sections where internal walls in which bearings of the first rotary conveying body and the second rotary conveying body are positioned intersect with internal walls that are parallel to the first rotary conveying body and the second rotary conveying body, and an abutting member, installed in at least either one of bearings of the first rotary conveying body and the second rotary conveying body, rotates along with the bearing of the rotary conveying body in which the abutting member is installed, and abuts on an internal wall that is parallel to the rotary conveying body in which the abutting member is installed.

In another aspect of the present invention, an image forming apparatus comprises a development device. The development device comprises a developer carrier that develops an electrostatic latent image to obtain a toner image; a first chamber that houses a first rotary conveying body supplying a developer to the developer carrier; and a second chamber that houses a second rotary conveying body that rotates to convey a developer in a direction opposite to the direction in which the first rotary conveying body conveys the developer. The first chamber and the second chamber are partitioned by a partition member having an opening section at each end thereof, whereby the developer is circulated and moved via the opening sections. A curving surface section is provided in at least one of four sections where internal walls in which bearings of the first rotary conveying body and the second rotary conveying body are positioned intersect with internal walls that are parallel to the first rotary conveying body and the second rotary conveying body, and an abutting member, installed in at least either one of bearings of the first rotary conveying body and the second rotary conveying body, rotates along with the bearing of the rotary conveying body in which the abutting member is installed, and abuts on an internal wall that is parallel to the rotary conveying body in which the abutting member is installed.

In another aspect of the present invention, an image forming apparatus comprises a process cartridge constituted by a development device and an image carrier. The process cartridge is detachable to the image forming apparatus. The development device comprises a developer carrier that develops an electrostatic latent image to obtain a toner image; a first chamber that houses a first rotary conveying body supplying a developer to the developer carrier; and a second chamber that houses a second rotary conveying body that rotates to convey the developer in a direction opposite to a direction in which the first rotary conveying body conveys the developer. The first chamber and the second chamber are partitioned by a partition member having an opening section at each end thereof, whereby the developer is circulated and moved via the opening sections. A curving surface section is provided in at least one of four sections where internal walls in which bearings of the first rotary conveying body and the second rotary conveying body are positioned intersect with internal walls that are parallel to the first rotary conveying body and the second rotary conveying body, and an abutting member, installed in at least either one of bearings of the first rotary conveying body and the second rotary conveying body, rotates along with the bearing of the rotary conveying body in which the abutting member is installed, and abuts on an internal wall that is parallel to the rotary conveying body in which the abutting member is installed.

BRIEF DESCRIPTION OF THE DRAWINGS

The above and other objects, features and advantages of the present invention will become more apparent from the following detailed description taken with the accompanying drawings in which:

FIGS. 9A and 9B each shows the relationship between these walls;

DESCRIPTION OF THE PREFERRED EMBODIMENTS

Before explaining the present invention, the abovementioned problems of the conventional technology are described with reference to the drawings.

Figure 1:
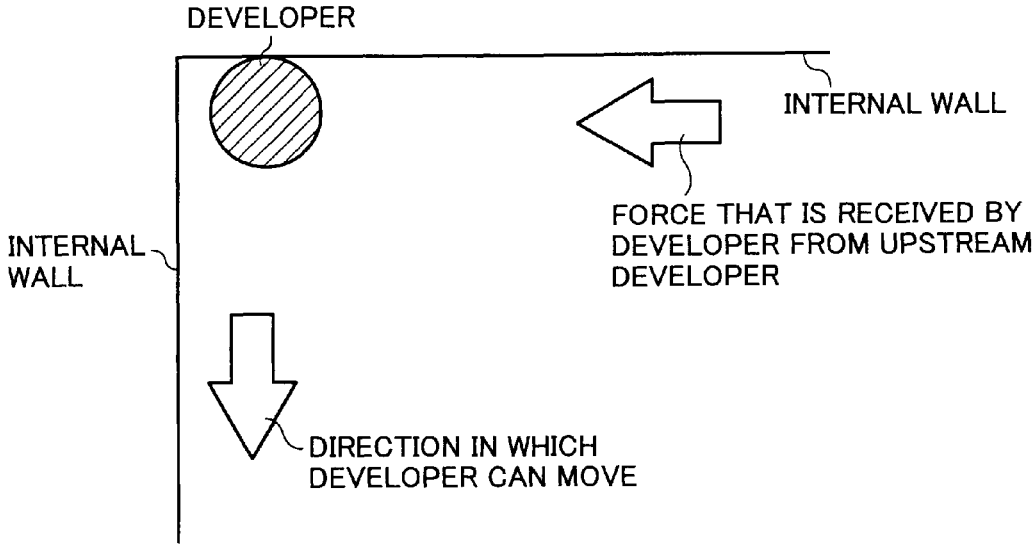
FIG. 1 PRIOR ART
FIG. 1 is a figure for explaining the problems of a conventional development device.
Figure 2:
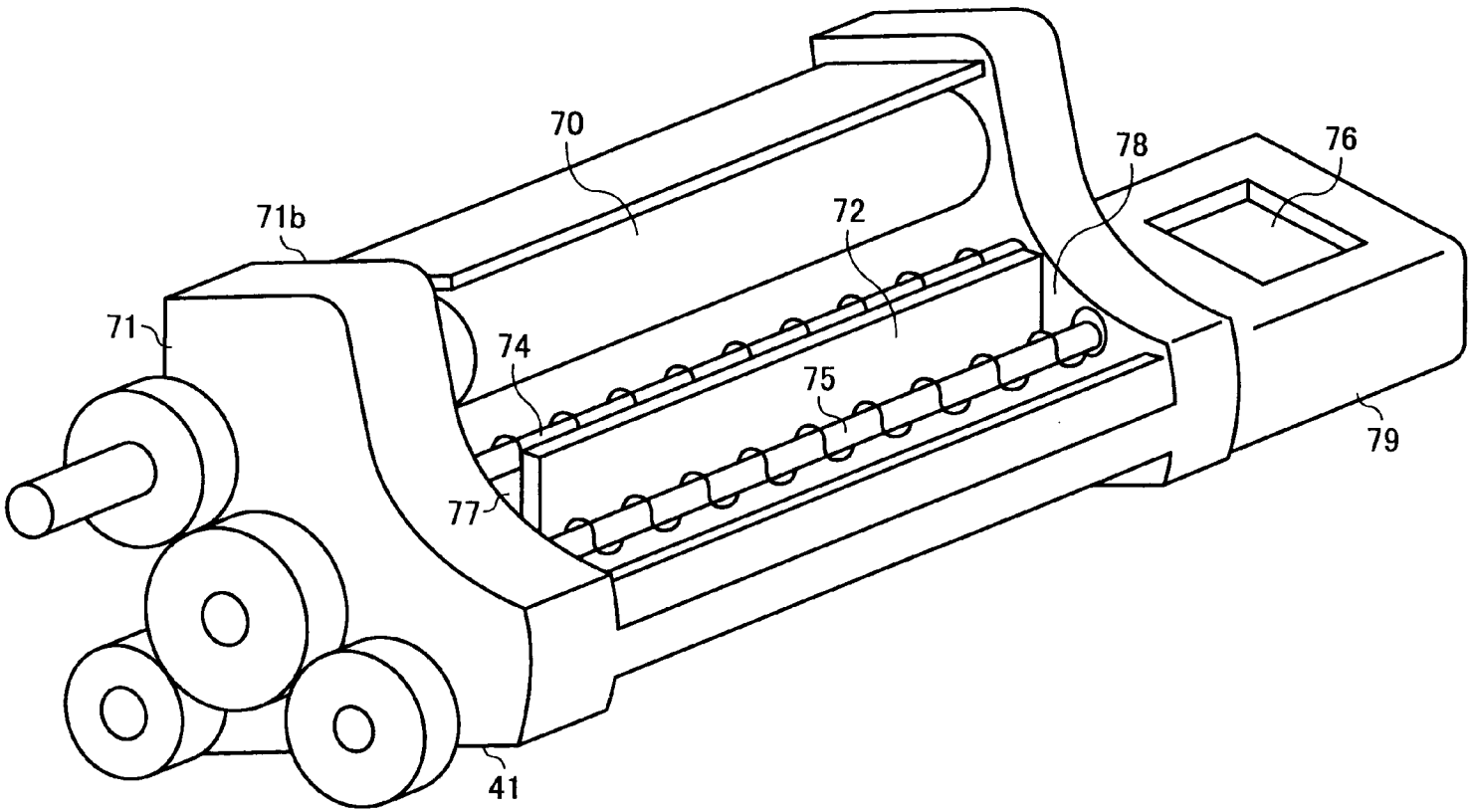
FIG. 2 PRIOR ART
FIG. 2 is an external perspective view showing a configuration of the conventional development device.

FIG. 1 shows a state in which developer is accumulated at a corner on an internal wall of a development device in which the developer is circulated and conveyed between a first chamber and a second chamber by two rotary conveying bodies, as described above. FIG. 2 shows the conventional development device disclosed in the abovementioned Japanese Unexamined Patent Publication No. 2006-003524.

This publication describes the development device shown in FIG. 2. Specifically, there is disclosed "a configuration in which a chassis 71 is partitioned into a first chamber and a second chamber by a partition plate 72, a developing roller 70 and a first rotary conveying body 74 are provided in the first chamber, a second rotary conveying body 75 is provided in the second chamber, an extending section 73 the inside of which is partitioned by a partition plate 79 is provided in a side section of the chassis 71 on one side of an axial direction of a developing roller 70, and developer is circulated in the sections in the order of the first chamber, extending section 73, and second chamber by rotating the first and second rotary conveying bodies 74, 75, wherein a developer supply port 77 is provided in the vicinity of an end section on the other side of the axial direction of the developing roller 70, a first circulating port 78 is provided in the vicinity of an end section on the one side of the axial direction of the developing roller 70, and a second circulating port 80 is provided in the extending section 73, whereby the first chamber and the second chamber are communicated with each other, partial developer located in the vicinity of the end section on the one side of the axial direction of the developing roller 70 is sent back to the second chamber via the first circulating port 78."

However, as described above, since it is necessary to configure the first and second rotary conveying bodies to be longer than the developer carrier, there is generated a problem that the size of the development device increased and the production cost also increases.

Hereinafter, an embodiment of the present invention is described with reference to the drawings.

Figure 3:
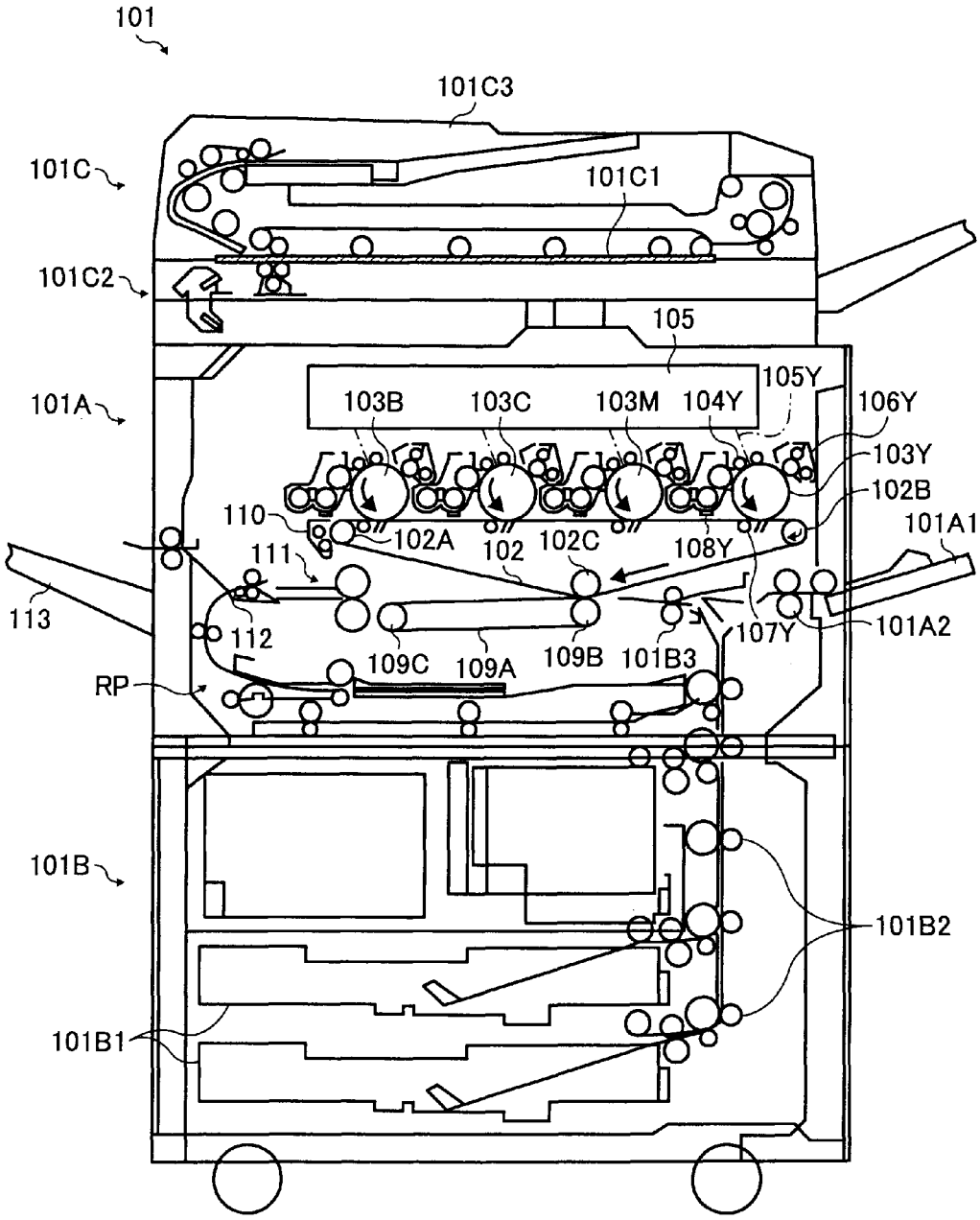
FIG. 3 is a figure showing a tandem color copying machine as an image forming apparatus according to an embodiment of the present invention.

FIG. 3 shows a tandem color copying machine as an image forming apparatus of the present embodiment.

A color copying machine 101 has an image forming section 101A located in the central part of the apparatus main body, a paper feeding section 101B located in a lower section of the image forming section 101A, an original copy conveying section 101C located in an upper section of the image forming section 101A, and a scanner section.

The image forming section 101A has disposed therein an intermediate transfer belt 102 which is an intermediate transfer body having a transfer surface extending in a horizontal direction, and a top surface of the intermediate transfer belt 102 is provided with a configuration for forming an image of colors having a relationship of a color-separation color and of a complementary color. Specifically, photoconductors 103Y, 103M, 103C and 103B, which are image supporting bodies capable of supporting images obtained by toners (yellow, magenta, cyan, black) having the complementary color, are arranged along the transfer surface of the intermediate transfer belt 102.

The photoconductors 103Y, 103M, 103C and 103B are constituted respectively by drums that are capable of rotating in the same direction (counterclockwise direction). A charging device 104 that executes image formation processing during a rotation procedure, a writing device 105 which is optical writing means, a developing device 108, a primary transfer device 107, and a cleaning device 106 are disposed around each drum. An alphabet provided in each reference numeral corresponds to the color of toner as with the photoconductors 103. In FIG. 1, codes are applied to the charging device 104Y, developing device 108Y, primary transfer device 107Y and cleaning device 106Y corresponding to yellow, but the same thing applies to the devices for different colors. 105Y indicates writing light of a yellow toner image. A toner of each color is stored in each developing device 108. The intermediate transfer belt 102 is wrapped around a driving roller 102B and a driven roller 102A to have a configuration in which a paper can moving in the same direction at positions facing the photoconductors 103Y, 103M 103C and 103B. A cleaning device 110 for cleaning the surface of the intermediate transfer belt 102 is provided at the position facing the driven roller 102A.

The surface of the photoconductor 103Y is charged uniformly by the charging device 104Y, and an electrostatic latent image is formed on the photoconductor 103Y on the basis of image information obtained from the scanner section. The electrostatic latent image is made visible as a toner image by the developing device 108Y in which the yellow toner is stored. The toner image is then primarily transferred onto the intermediate transfer belt 102 by the primary transfer device 107Y to which a predetermined bias is applied. The same image formation is performed in the other photoconductors 103M, 103C and 103B, except that the colors of the toners thereof are different, whereby toner images in these colors are sequentially transferred onto the intermediate transfer belt 102 and superimposed on one another. The toners remaining on the photoconductors 103 after the transfer are removed by the cleaning device 106, and the potential of each photoconductor 103 is initialized by an unshown neutralization lamp after the transfer, to prepare for the next image-creating step.

The paper feeding section 101B has: a paper feeding tray 101B1 for stacking and storing papers P as recording media; a paper feeding roller for sequentially separating the papers P within the paper feeding tray 101B1, one by one, and feeding each paper; a pair of conveying rollers 101B2 for conveying the fed papers P; a pair of resist rollers 101B3, to a nip N of which each paper P is fed at timing at which a leading edge of the image on the intermediate transfer belt 102 and a predetermined position in a conveyance direction fit to each other after the paper P is stopped once to correct the tilted position thereof. An unshown sensor for detecting reflectance of the paper surface is provided in the vicinity of the pair of resist rollers 101B3, and, in the case of a value different from a sensor output obtained in a previous step, the intermediate transfer belt 102 and an opposing roller 102C are switched.

A bias (including AC, superimposed pulses, and the like) is applied to the opposing roller 102C by unshown secondary transfer bias applying means, and an electric field acts between the opposing roller 102C and a secondary transfer roller 109B via the intermediate transfer belt 102, whereby the toner image T (simply called "toner" hereinafter) that is primarily transferred onto the intermediate transfer belt 102 from each of the photoconductors 103Y, 103M, 103C and 103B is secondarily transferred onto the paper P.

Thereafter, on the paper P having the toner image T transferred secondarily on the surface thereof, the toner image is fixed solidly to the surface by means of the action of heat and pressure by a fixing device 111.

Figure 4:
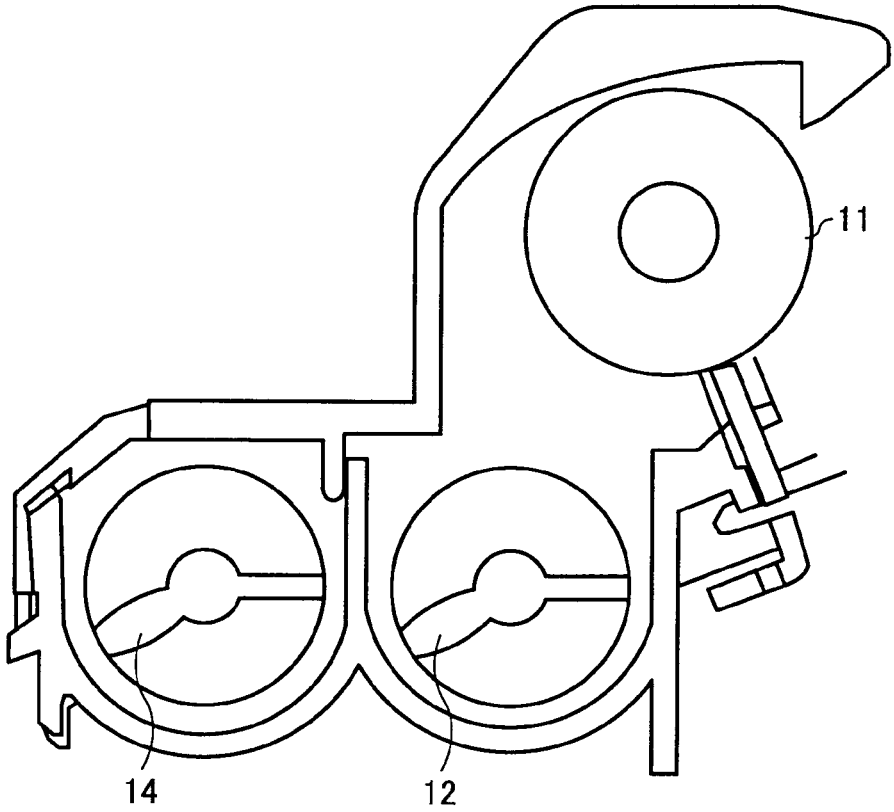
FIG. 4 is a cross-sectional view showing a configuration of a development device according to the present embodiment.

FIG. 4 shows the development device. As shown, the development device has a developer carrier 11 that develops an electrostatic latent image to obtain a toner image, a first rotary conveying body 12 that conveys the developer to the developer carrier 11 while stirring the developer, and a second rotary conveying body 14 that rotates and conveys the developer in a direction opposite to the direction in which the first rotary conveying body 12 conveys the developer. Here, this development device is referred to as a development device A.

Figure 5:
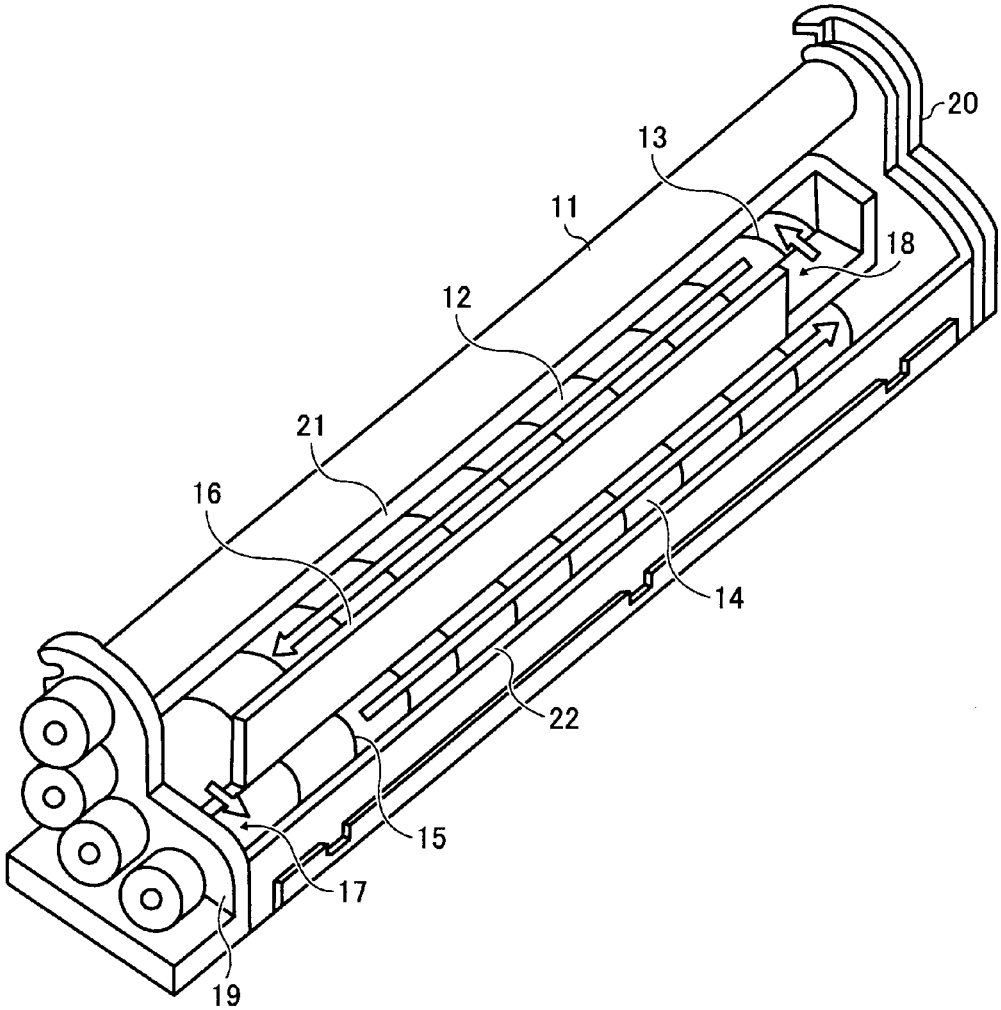
FIG. 5 is an exterior perspective view showing a configuration of the above development device.

Also, in the development device of the present invention shown in FIG. 5, a reference numeral 13 represents the first chamber that stores the first rotary conveying body 12, a reference numeral 15 represents the second chamber that stores the second rotary conveying body 14, a reference numeral 16 represents a partition member with an opening section at each end thereof, which partitions the first chamber 13 and the second chamber 15, and reference numerals 17 and 18 represent opening section, wherein the developer is circulated and moved via the opening sections 17, 18. In the present invention, at least one of four sections where an internal wall P19 and an internal wall Q20, on which the bearings of the first rotary conveying body 12 and the second rotary conveying body 14 are positioned, intersect with an internal wall R21 and an internal wall S22 that are parallel to the rotary conveying bodies 12, 14 has a curving surface section.

Figure 6:
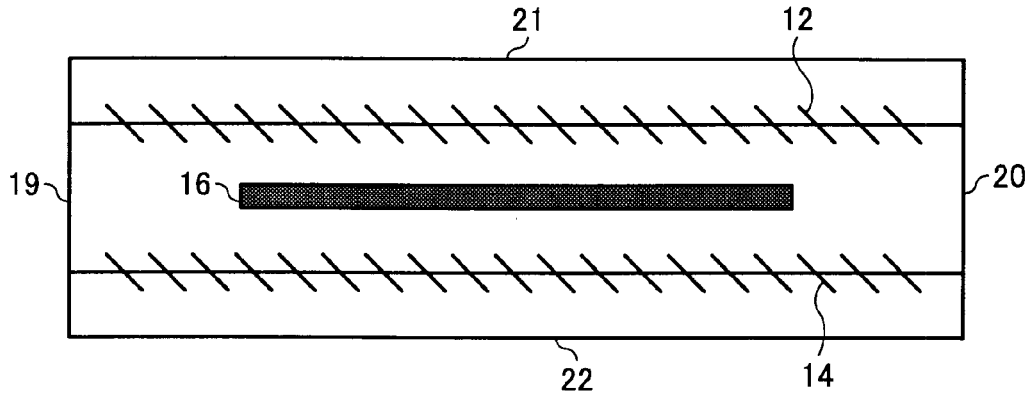
FIG. 6 PRIOR ART
FIG. 6 is a figure in which the conventional development device is viewed from above.
Figure 7:
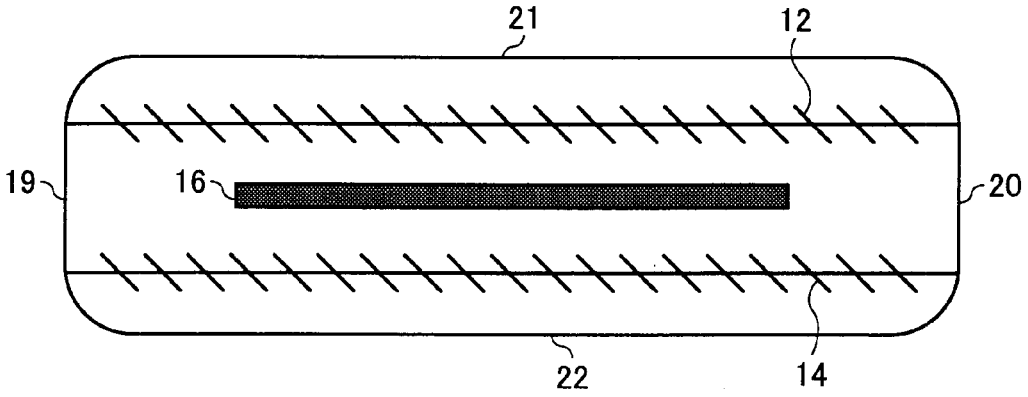
FIG. 7 is a figure in which the development device of the present embodiment is viewed from above.

FIG. 6 is a figure in which the conventional development device is viewed from above, and FIG. 7 is a figure in which the development device of the present invention is viewed from above. In the development device of the present invention, four sections where the internal wall P19 and internal wall Q20, on which the bearings of the first rotary conveying body 12 and the second rotary conveying body 14 are positioned, intersect with the internal wall R21 and internal wall S22 that are parallel to the rotary conveying bodies 12, 14 have curving surface sections. Accordingly, the force coming from the upstream developer that is received by the developer positioned in the vicinity of end sections of the rotary conveying bodies 12, 14 is changed to the force flowing to the downstream, whereby the developer positioned in a corner of the internal wall can be prevented from accumulating.

Figure 8:
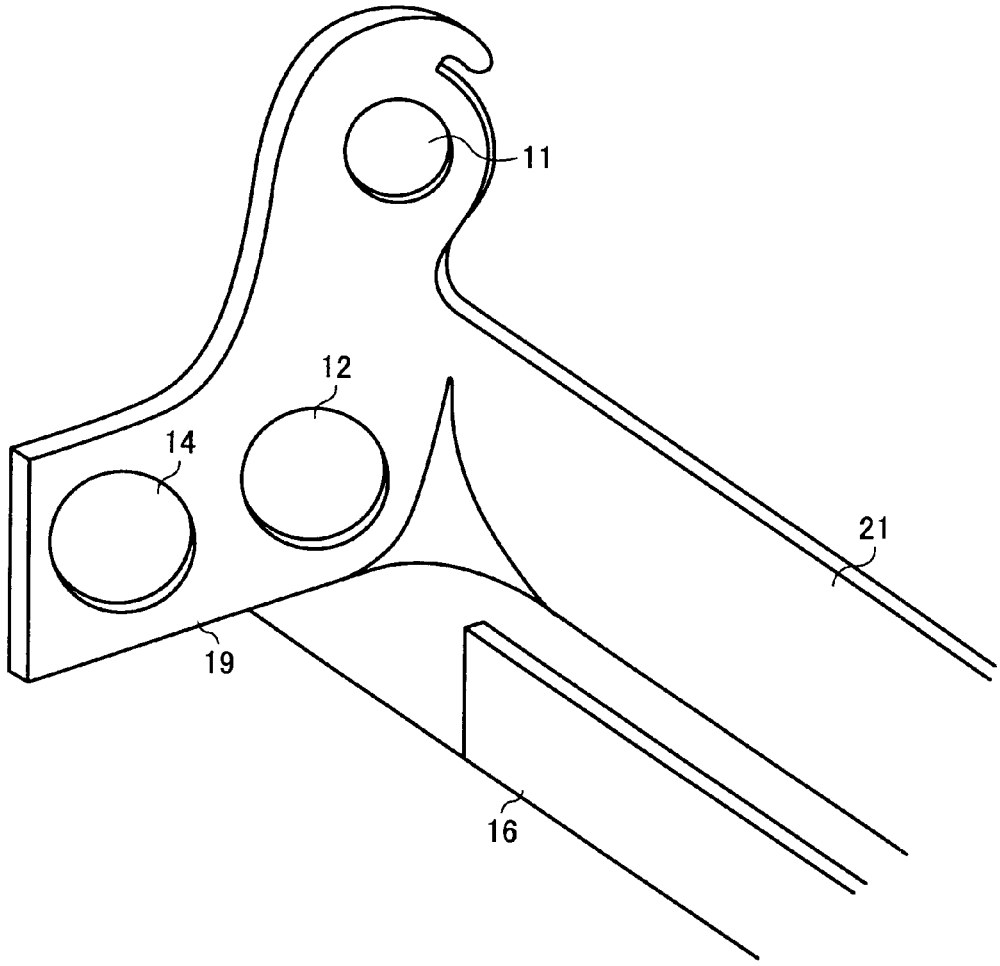
FIG. 8 is a figure showing a corner where an internal wall P and an internal wall R intersect with each other.

FIG. 8 shows a corner where the internal wall P intersects with the internal wall R. For the developer carrier 11, first rotary conveying body 12 and second rotary conveying body 14, only the bearings thereof are shown.

FIGS. 9A and 9B each shows the relationships between the internal wall P19, the internal wall Q20, and the internal wall R21, the internal wall S22 that are parallel to the rotary conveying bodies 12, 14.

Here, a development device in which the four corners on the internal walls of the development device A are formed into the shapes show in FIGS. 8, 9A and 9B is taken as a development device B.

Figure 10:
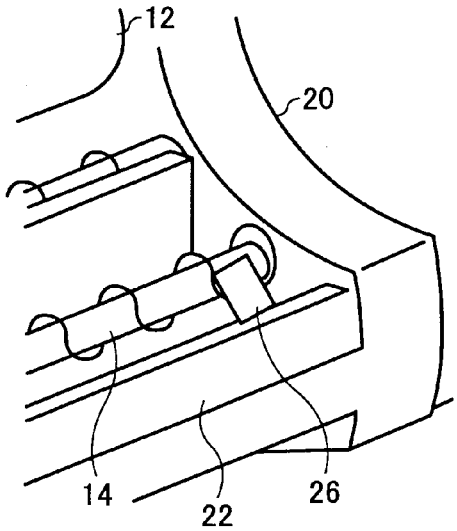
FIG. 10 is a figure showing a partial configuration of the development device having an abutting member.

FIG. 10 shows a development device having an abutting member. The abutting member is installed in at least either one of the bearings of the first rotary conveying body 12 and the second rotary conveying body 14. The abutting member rotates along with the bearing of the rotary conveying body 12, 14 in which the abutting member is installed, and abuts on the internal wall R21 or the internal wall S22 parallel to the rotary conveying body 12, 14 in which the abutting member is installed. FIG. 10 shows an abutting member 26 that rotates along with the bearing of the second rotary conveying body 14 and abuts on the internal wall S22. Since the abutting member 26 scoops out the developer positioned on the corner of the internal wall S22 toward the downstream, thus the developer on the corner of the internal wall S22 can be prevented from accumulating.

Figure 11:
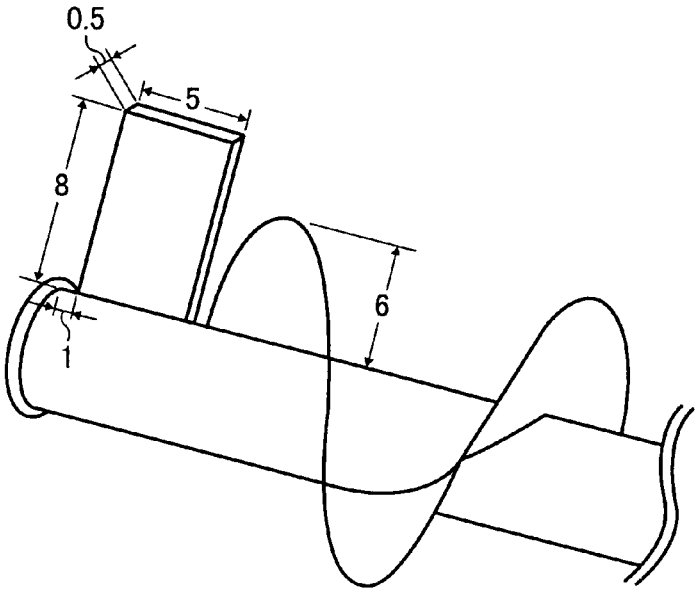
FIG. 11 is a figure showing a rotary conveying body and the abutting member.
Figures 12, 13:
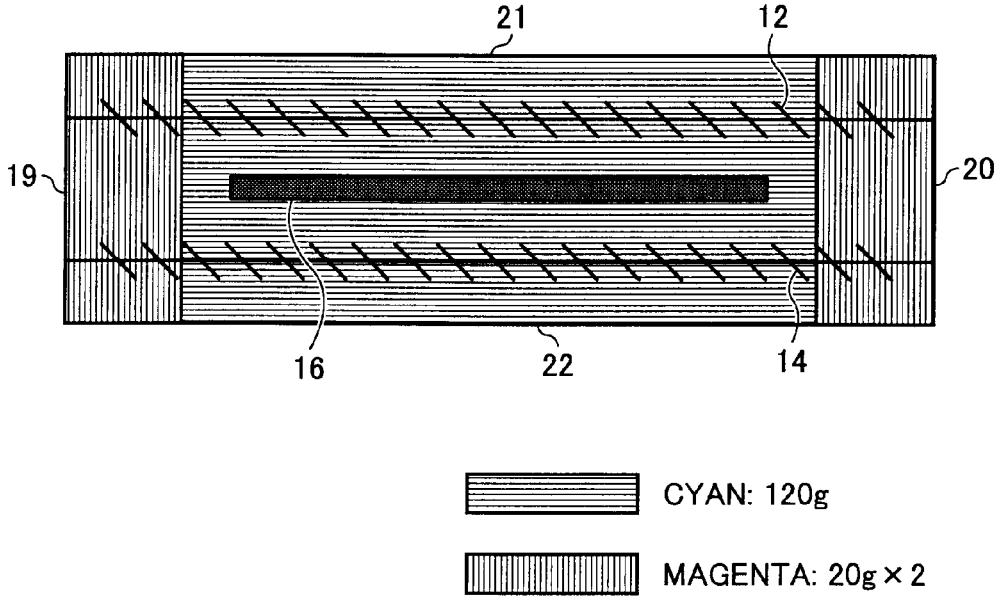
FIG. 12 is a figure showing the position/size of a Mylar to be attached to an end section of the rotary conveying body.
FIG. 13 is a figure showing the development device when a test for checking accumulation of the developer is performed.

FIG. 11 shows the rotary conveying bodies and the abutting member. FIG. 12 shows a specification of the abutting member 26 MYLAR®. Here, a development device A in which a rectangular MYLAR®having the position/size shown in FIGS. 11 and 12 is attached to the end sections of the first rotary conveying body 12 and second rotary conveying body 14 (total of four sections) is taken as a development device C.

For the development devices A, B and C described above, the accumulation property of each developer positioned on each of the four corners of the internal walls were examined to confirm the effectiveness of the present invention.

In each of the development devices A, B and C, 20 g of a cyan developer is placed on each side in the vicinity of the bearing of the rotary conveying body, and 120 g of a magenta developer is placed in other section. FIG. 13 is a figure showing the development device on which the experiment for checking the developer accumulation is performed.

Each of the development devices was idled for two hours continuously at a linear speed that is used at normal usage of the development devices. After idling, the developer positioned on each of the four corners of the internal walls of the development device (mixture of magenta and cyan) is removed slowly, and the mass of the cyan developer positioned therebelow (developer that is not mixed with magenta) was examined. Here, the cyan developer in which magenta is not mixed after idling is the developer that has been accumulated since the start of the idling, thus this developer can be used as an indicator to know the degree of accumulation.

Figures 14, 15:
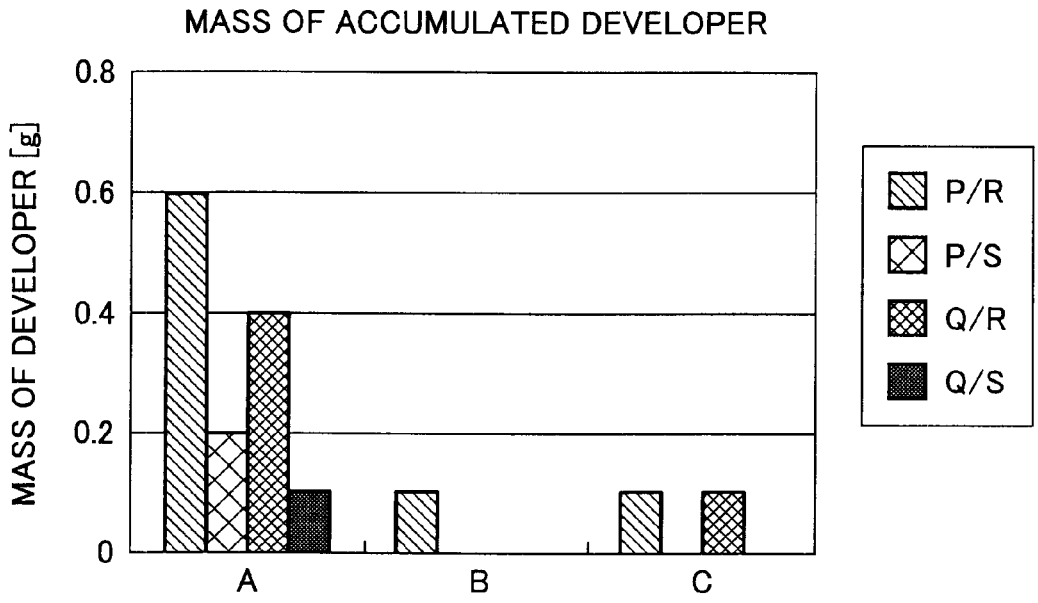
FIG. 14 is a figure showing the result of the accumulation checking test.
FIG. 15 is a figure showing the results of checking of accumulation property of the developer at four corners on internal walls of each of development devices A, B and C.

The results are shown in FIGS. 14 and 15.

Compared to the case in which the development device A is used, in the case in which the development device B or C is used, almost no developers were accumulated in the four corners. The accumulation property of each developer was improved.

Moreover, in the present embodiment, the curving surface section is provided in at least one of the four sections where the internal walls 19, 20 having the bearing of the first rotary conveying body 12 and the second rotary conveying body 14 intersect with the internal walls 21, 22 that are parallel to the first rotary conveying body 12 and the second rotary conveying body 14, and the abutting member is further provided, whereby the effects can be improved more.

Figure 16:
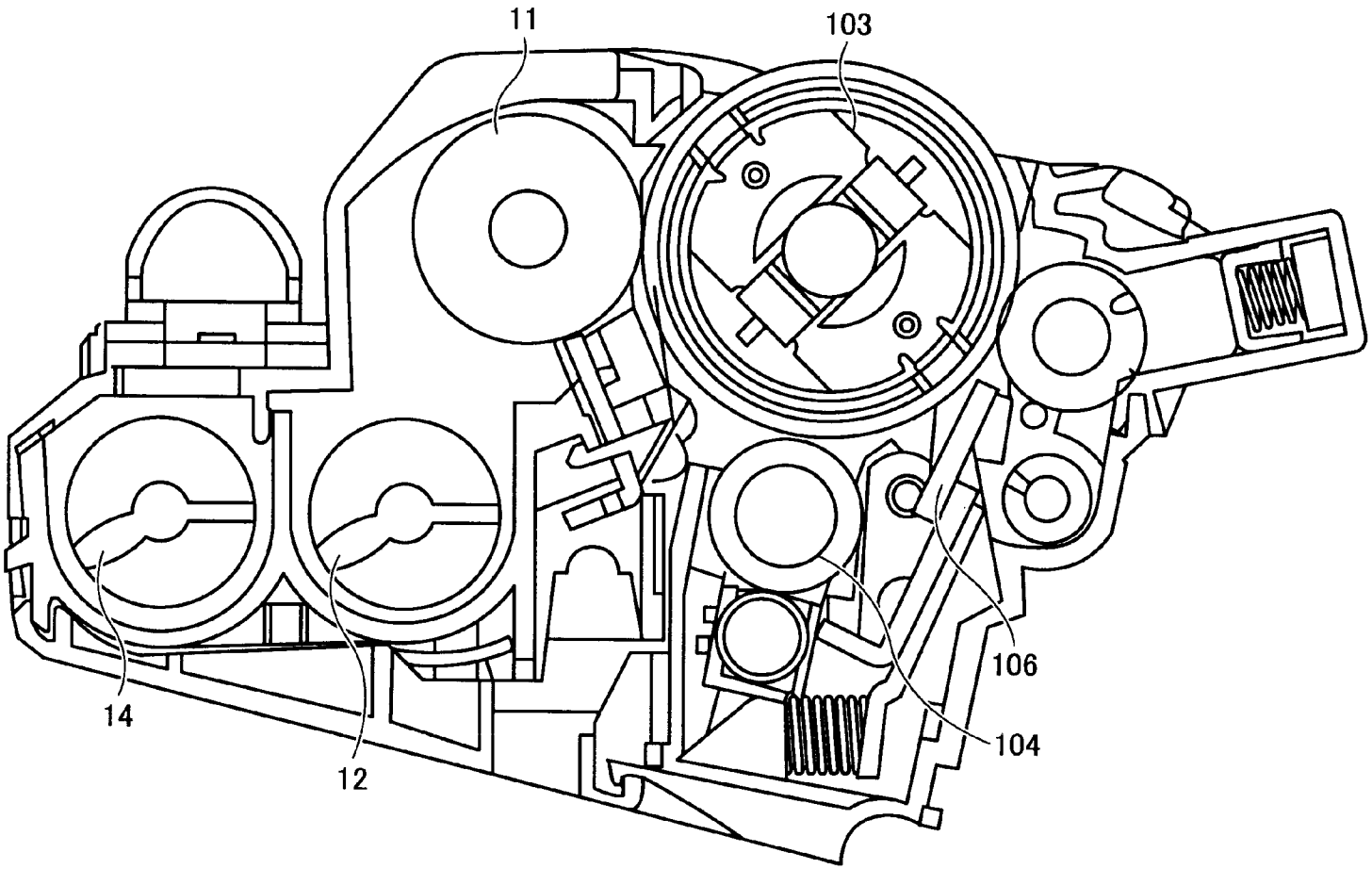
FIG. 16 is a figure showing a configuration of a process cartridge of the present invention.

FIG. 16 shows the process cartridge of the present invention. Also, FIG. 17 shows an image carrier, charging device and cleaning device.

Figure 17:
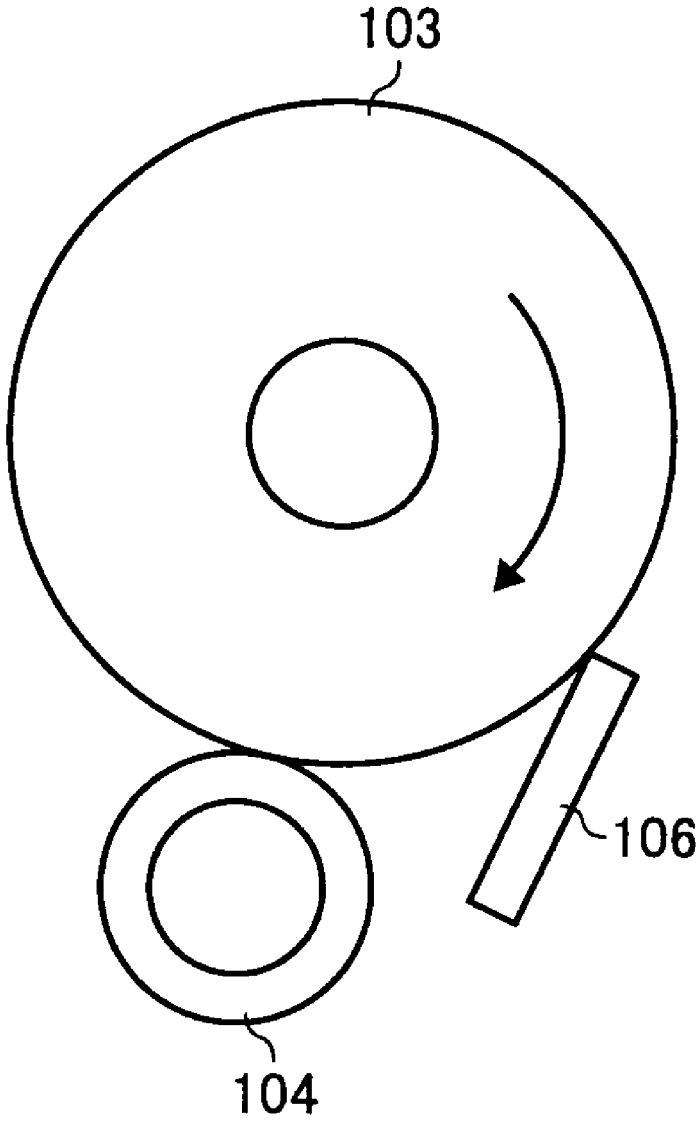
FIG. 17 is a figure showing an image carrier, a charging device, and a cleaning device.

The process cartridge shown in FIG. 16 has an image carrier 103 for supporting the electrostatic latent image shown in FIG. 17, the charging device 104 for charging the image carrier 103, the cleaning device 106 for removing the transferred residual toner remaining on the image carrier 103 after the developed toner image is transferred to a transfer material, and the development device B or C.

The process cartridge of the present invention has the development device, thus the development device in which developer aggregation hardly occurs, uniformity of the toner density and charging amount can be improved, and a stable image can be formed can be freely attached to and detached from the image forming apparatus main body.

The image forming apparatus of the present invention has the development device or the process cartridge. Accordingly, developer aggregation hardly occurs and the uniformity of the toner density and charging amount can be improved, whereby a stable image can be formed.

As described above, the present invention can provide a development device which does not accumulate the developers at the corners on the internal walls, the process cartridge having such development device, and the image forming apparatus, without increasing the size of the apparatuses or complicating the structures of the apparatuses.

Various modifications will become possible for those skilled in the art after receiving the teachings of the present disclosure without departing from the scope thereof.

What is claimed is:

1. A development device, comprising:

a developer carrier that develops an electrostatic latent image to obtain a toner image;

a first chamber that houses a first rotary conveying body which conveys a developer to the developer carrier; and a second chamber that houses a second rotary conveying body which rotates to convey the developer in a second direction opposite to a direction in which the first rotary conveying body conveys the developer, wherein the first chamber and the second chamber are partitioned by a partition member including first and second opening sections at each end thereof, whereby the developer is circulated and moved via the opening sections when the first and second rotary conveying bodies rotate, a first curved surface is provided in at least one of four sections where internal walls in which bearings of the first rotary conveying body and the second rotary conveying body are positioned intersect with internal walls that are parallel to the bearings, a second curved surface is provided in a second of the four sections, the first curved surface and the second curved surface are disposed on the same end of the development device, and the second curved surface faces the first curved surface through the first opening section.

2. The development device according to claim 1, wherein a third curved surface is provided in a third of the four sections, the third curved surface facing the second curved surface in the direction in which the second rotary body conveys the developer.

3. The development device according to claim 2, wherein a fourth curved surface is provided in a fourth of the four sections, the fourth curved surface facing the third curved surface through the second opening section.

4. A development device, comprising:

a developer carrier that develops an electrostatic latent image to obtain a toner image;

a first chamber that houses a first rotary conveying body which conveys a developer to the developer carrier; and a second chamber that houses a second rotary conveying body which rotates to convey the developer in a second direction opposite to a first direction in which the first rotary conveying body conveys the developer, wherein the first chamber and the second chamber are partitioned by a partition member including first and second opening sections at each end thereof, whereby the developer is circulated and moved via the opening sections when the first and second rotary conveying bodies rotate, a first curved surface is provided in at least one of four sections where internal walls in which bearings of the first rotary conveying body and the second rotary conveying body are positioned intersect with internal walls that are parallel to the bearings, a second curved surface is provided in a second of the four sections, the first curved surface and the second curved surface are disposed on the same end of the development device, the second curved surface faces the first curved surface through the first opening section, and an abutting member, extending from at least one of bearings of the first rotary conveying body and the second rotary conveying body, rotates along with the bearing of the rotary conveying body in which the abutting member is installed, is disposed between a rotary conveying body and the internal wall in which the bearing is positioned, is a planar member extending radially from the bearing of the rotary conveying body, and abuts an internal wall that is parallel to the bearing from which the abutting member extends.

5. The development device according to claim 4, wherein a third curved surface is provided in a third of the four sections, the third curved surface facing the second curved surface in the direction in which the second rotary body conveys the developer.

6. The development device according to claim 5, wherein a fourth curved surface is provided in a fourth of the four sections, the fourth curved surface facing the third curved surface through the second opening section.

7. The development device according to claim 4, wherein the abutting member is separate from blades disposed on the rotary conveying body.

8. The development device according to claim 4, wherein the abutting member extends radially at a distance greater than blades disposed on the rotary conveying body.

9. A process cartridge configured to detachably connect to an image forming apparatus, the process cartridge comprising:

a development device; and an image carrier that supports an electrostatic latent image, the development device including a developer carrier that develops an electrostatic latent image to obtain a toner image;

a first chamber that houses a first rotary conveying body which conveys a developer to the developer carrier; and a second chamber that houses a second rotary conveying body which rotates to convey the developer in a second direction opposite to a first direction in which the first rotary conveying body conveys the developer, wherein the first chamber and the second chamber are partitioned by a partition member including first and second opening sections at each end thereof, whereby the developer is circulated and moved via the opening sections when the first and second rotary conveying bodies rotate, a first curved surface is provided in at least one of four sections where internal walls in which bearings of the first rotary conveying body and the second rotary conveying body are positioned intersect with internal walls that are parallel to the bearings, a second curved surface is provide in a second of the four sections, the first curved surface and the second curved surface are disposed on the same end of the development device, the second curved surface faces the first curved surface through the first opening section, and an abutting member, extending from at least one of bearings of the first rotary conveying body and the second rotary conveying body, rotates along with the bearing of the rotary conveying body in which the abutting member is installed, is disposed between a rotary conveying body and the internal wall in which the bearing is positioned, is a planar member extending radially from the bearing of the rotary conveying body, and abuts an internal wall that is parallel to the bearing from which the abutting member extends.

10. The process cartridge as claimed in claim 9, further comprising at least one of a charging device for charging the image carrier, and a cleaning device for removing residual toner after transfer that remains on the image carrier after the developed toner image is transferred onto a transfer material.

11. The process cartridge according to claim 9, wherein the abutting member is separate from blades disposed on the rotary conveying body.

12. The process cartridge according to claim 9, wherein the abutting member extends radially at a distance greater than blades disposed on the rotary conveying body.

13. An image forming apparatus comprising:

a development device, the development device including a developer carrier that develops an electrostatic latent image to obtain a toner image;

a first chamber that houses a first rotary conveying body which conveys a developer to the developer carrier; and a second chamber that houses a second rotary conveying body which rotates to convey a developer in a second direction opposite to the direction in which the first rotary conveying body conveys the developer, wherein the first chamber and the second chamber are partitioned by a partition member including first and second opening sections at each end thereof, whereby the developer is circulated and moved via the opening sections when the first and second rotary conveying bodies rotate, a first curved surface is provided in at least one of four sections where internal walls in which bearings of the first rotary conveying body and the second rotary conveying body are positioned intersect with internal walls that are parallel to the bearings, a second curved surface is provided in a second of the four sections, the first curved surface and the second curved surface are disposed on the same end of the development device, the second curved surface faces the first curved surface through the first opening section, and an abutting member, extending from at least one of bearings of the first rotary conveying body and the second rotary conveying body, rotates along with the bearing of the rotary conveying body in which the abutting member is installed, is disposed between a rotary conveying body and the internal wall in which the bearing is positioned, is a planar member extending radially from the bearing of the rotary conveying body, and abuts an internal wall that is parallel to the bearing from which the abutting member extends.

14. An image forming apparatus comprising:

a process cartridge including a development device and an image carrier, the process cartridge being detachable to the image forming apparatus, the development device including a developer carrier that develops an electrostatic latent image to obtain a toner image;

a first chamber that houses a first rotary conveying body which conveys a developer to the developer carrier; and a second chamber that houses a second rotary conveying body which rotates to convey the developer in a second direction opposite to a first direction in which the first rotary conveying body conveys the developer, wherein the first chamber and the second chamber are partitioned by a partition member including first and second opening sections at each end thereof, whereby the developer is circulated and moved via the opening sections when the first and second rotary conveying bodies rotate, a first curved surface is provided in at least one of four sections where internal walls in which bearings of the first rotary conveying body and the second rotary conveying body are positioned intersect with internal walls that are parallel to the bearings, a second curved surface is provided in a second of the four sections, the first curved surface and the second curved surface are disposed on the same end of the development device, the second curved surface faces the first curved surface through the first opening section, and an abutting member, extending from at least one of bearings of the first rotary conveying body and the second rotary conveying body, rotates along with the bearing of the rotary conveying body in which the abutting member is installed, is disposed between a rotary conveying body and the internal wall in which the bearing is positioned, is a planar member extending radially from the bearing of the rotary conveying body, and abuts an internal wall that is parallel to the rotary conveying body from which the abutting member extends.

* * * * *